US010508659B2

(12) United States Patent
Jin

(10) Patent No.: US 10,508,659 B2
(45) Date of Patent: Dec. 17, 2019

(54) COMPRESSOR

(71) Applicants: Hyundai Motor Company, Seoul (KR); Kia Motors Corporation, Seoul (KR)

(72) Inventor: Seok Beom Jin, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 173 days.

(21) Appl. No.: 15/701,260

(22) Filed: Sep. 11, 2017

(65) Prior Publication Data

US 2018/0274552 A1 Sep. 27, 2018

(30) Foreign Application Priority Data

Mar. 24, 2017 (KR) ..... 10-2017-0037752

(51) Int. Cl.
*F04D 29/44* (2006.01)
*F04D 29/42* (2006.01)
*F04D 17/10* (2006.01)

(52) U.S. Cl.
CPC ..... *F04D 29/444* (2013.01); *F04D 17/10* (2013.01); *F04D 29/4206* (2013.01)

(58) Field of Classification Search
None
See application file for complete search history.

(56) References Cited

U.S. PATENT DOCUMENTS 4,776,074 A * 10/1988 Suzuki ..... B23P 15/00 29/418
4,805,398 A * 2/1989 Jourdain ..... F01D 5/082 236/93 R
5,813,828 A * 9/1998 Norris ..... F01D 25/30 415/115
6,394,751 B1 * 5/2002 Daudel ..... F04D 27/0207 415/208.3
2005/0025633 A1 * 2/2005 Ichikawa ..... F01C 1/3446 417/273

(Continued)

FOREIGN PATENT DOCUMENTS

KR 10-2010-0054532 A 5/2010
KR 10-2012-0013460 A 2/2012
WO WO 2011/045975 A1 4/2011

*Primary Examiner* — Michael Lebentritt
(74) *Attorney, Agent, or Firm* — Morgan, Lewis & Bockius LLP

(57) ABSTRACT

A compressor may include a compressor housing configured to have a surge slit and a choking slit; an internal sleeve configured to be provided on the compressor housing; an external sleeve configured to be provided on an external side of the internal sleeve; a rotation interlocking device configured to rotate the internal sleeve depending on an axial linear movement of the external sleeve; a selection slit configured to be provided on the external sleeve to communicate with the surge slit or communicate with the choking slit depending on the axial linear movement of the external sleeve; and a plurality of vanes configured to be provided on an internal side of the internal sleeve so that the vanes are rotated depending on the axial linear movement of the external sleeve to adjust a flow of gas introduced into the compressor wheel.

8 Claims, 11 Drawing Sheets

(56) References Cited

U.S. PATENT DOCUMENTS

| | | | | |
|---|---|---|---|---|
| 2009/0169366 | A1* | 7/2009 | Petitjean | F01D 17/105 415/145 |
| 2010/0215485 | A1* | 8/2010 | Childe | F04D 29/444 415/203 |
| 2011/0194929 | A1* | 8/2011 | Denholm | F01D 17/143 415/157 |
| 2014/0064934 | A1* | 3/2014 | Husted | F04D 29/462 415/148 |
| 2015/0198164 | A1* | 7/2015 | Kulkami | F04D 29/624 415/204 |
| 2017/0191502 | A1* | 7/2017 | Ozaki | F04D 17/10 |
| 2017/0292441 | A1* | 10/2017 | Jin | F04D 29/4213 |
| 2017/0298957 | A1* | 10/2017 | Howe | F04D 25/028 |
| 2018/0216628 | A1* | 8/2018 | Rice | F04D 29/281 |
| 2018/0274554 | A1* | 9/2018 | Jin | F04D 27/0246 |
| 2019/0010958 | A1* | 1/2019 | Wang | F04D 29/44 |

* cited by examiner

COMPRESSOR

CROSS REFERENCE TO RELATED APPLICATION

The present application claims priority to Korean Patent Application No. 10-2017-0037752, filed on Mar. 24, 2017, the entire contents of which is incorporated herein for all purposes by this reference.

BACKGROUND OF THE INVENTION

Field of the Invention

The present invention relates to a compressor for compressing air, and more particularly, to a technology for a compressor configured for being used in a turbocharger or a supercharger mounted on a vehicle.

Description of Related Art

Referring to the performance curve of a centrifugal driving compressor, surge occurs when a flow rate flowing through the compressor is relatively small and a compression ratio, which is a ratio of an inlet pressure of the compressor to an outlet pressure, is relatively large and choking occurs when the compression ratio is relatively small when there is a relatively large flow rate.

The compressor mounted on a turbocharger may enter a surge area or a choking area depending on driving conditions (engine speed, load, whether to use an EGR, etc.) of a vehicle.

The information disclosed in the present Background of the Invention section is only for enhancement of understanding of the general background of the invention and may not be taken as an acknowledgement or any form of suggestion that the present information forms the prior art already known to a person skilled in the art.

BRIEF SUMMARY

Various aspects of the present invention are directed to providing a compressor configured for preventing surge or choking from occurring as much as possible even under the conditions that the compressor enters a surge area or a choking area to substantially reduce the surge area or the choking area and increase an effective operation area of the compressor, improving operation stability of the compressor to contribute to improvement in output performance of a vehicle.

According to an exemplary embodiment of the present invention, there is provided a compressor, including: a compressor housing configured to have a surge slit and a choking slit that are sequentially disposed along an axial direction of a compressor wheel; an internal sleeve configured to be provided on the compressor housing to guide a flow of gas introduced into the compressor wheel, form a concentric axis with the compressor wheel, and be rotatable on the concentric axis but unmovable along the axial direction; an external sleeve configured to be provided on an external side of the internal sleeve concentrically with the internal sleeve and be linearly movable along the axial direction with respect to the compressor housing but unrotatable; a rotation interlocking device configured to rotate the internal sleeve depending on an axial linear movement of the external sleeve; a selection slit configured to be provided on the external sleeve to communicate with the surge slit or communicate with the choking slit depending on the axial linear movement of the external sleeve; and a plurality of vanes configured to be provided on an internal side of the internal sleeve so that the vanes are rotated depending on the axial linear movement of the external sleeve to adjust the flow of gas introduced into the compressor wheel.

The surge slit and the choking slit may be sequentially disposed at a portion surrounding a circumferential external side of the compressor wheel along the introduction direction of gas into the compressor wheel such that some of the gas introduced into the compressor wheel is got out.

The surge slit and the choking slit may each be formed in a shape in which a plurality of arcs are disposed at intervals in parallel to a plane perpendicular to an axial direction of the compressor wheel.

The selection slit of the external sleeve may be formed in an arc shape parallel to the plane perpendicular to the axial direction of the compressor wheel.

The rotation interlocking device may include: a plurality of external protrusions configured to protrude from the external circumferential surface of the internal sleeve; and inclined slits configured to be formed on the external sleeve to be inclined with respect to the axial direction so that the external protrusion is inserted thereinto and guided.

An inside center portion of the external sleeve may be provided with an ogive for fixing a rotation shaft of the vane, an internal circumferential surface of the internal sleeve may be provided with a plurality of internal protrusions protruding to rotate the vane, and the vane may be provided with protrusion guide grooves having the internal protrusions inserted thereinto to rotate the vane depending on a displacement of the internal protrusion.

The rotation shaft of the vane, the protrusion guide grooves, and the internal protrusions of the internal sleeve may be formed such that the vane is parallel to the axial direction of the compressor wheel to allow the vane to minimize a flow resistance of gas introduced into the compressor wheel in the state where the selection slit of the external sleeve is positioned between the surge slit and the choking slit, and the vanes may each be rotated in an inclined state in an opposite direction to each other with respect to the axial direction in the state where the selection slit communicates with the surge slit and the choking slit, respectively.

The external sleeve may be integrally or monolithically provided with an operating rod for receiving an actuating force for linearly moving the external sleeve along the axial direction thereof.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
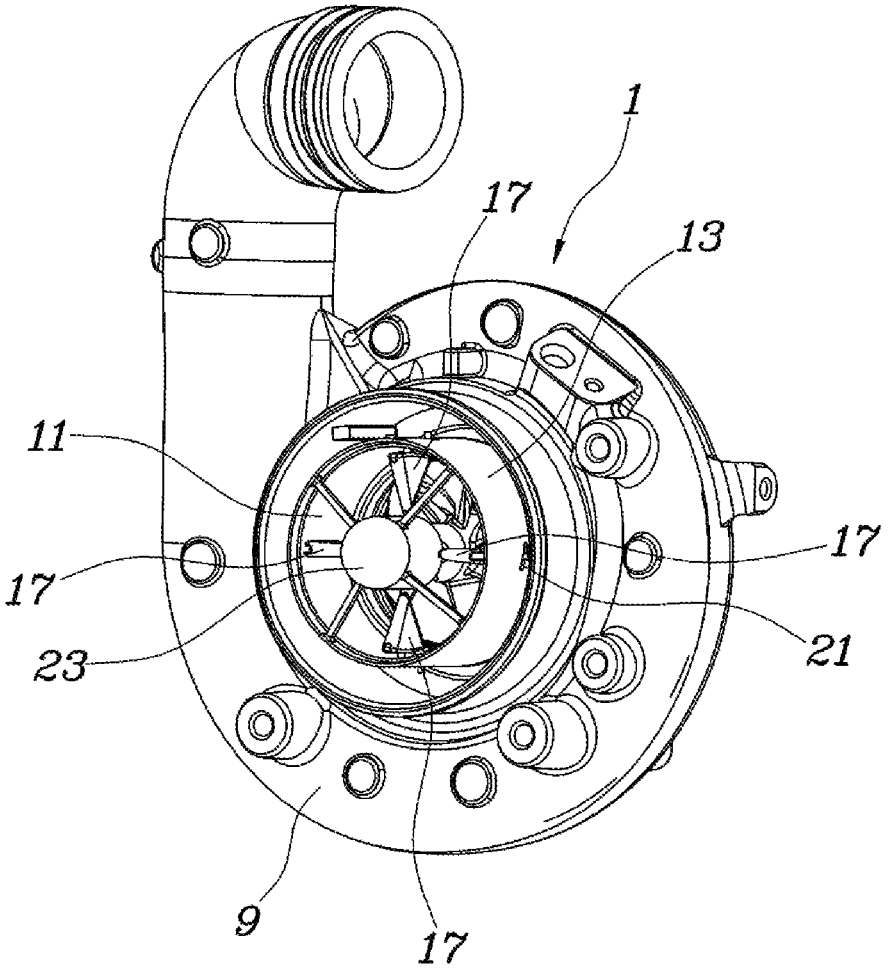
FIG. 1 is a view illustrating a compressor according to the invention.
Figure 2:
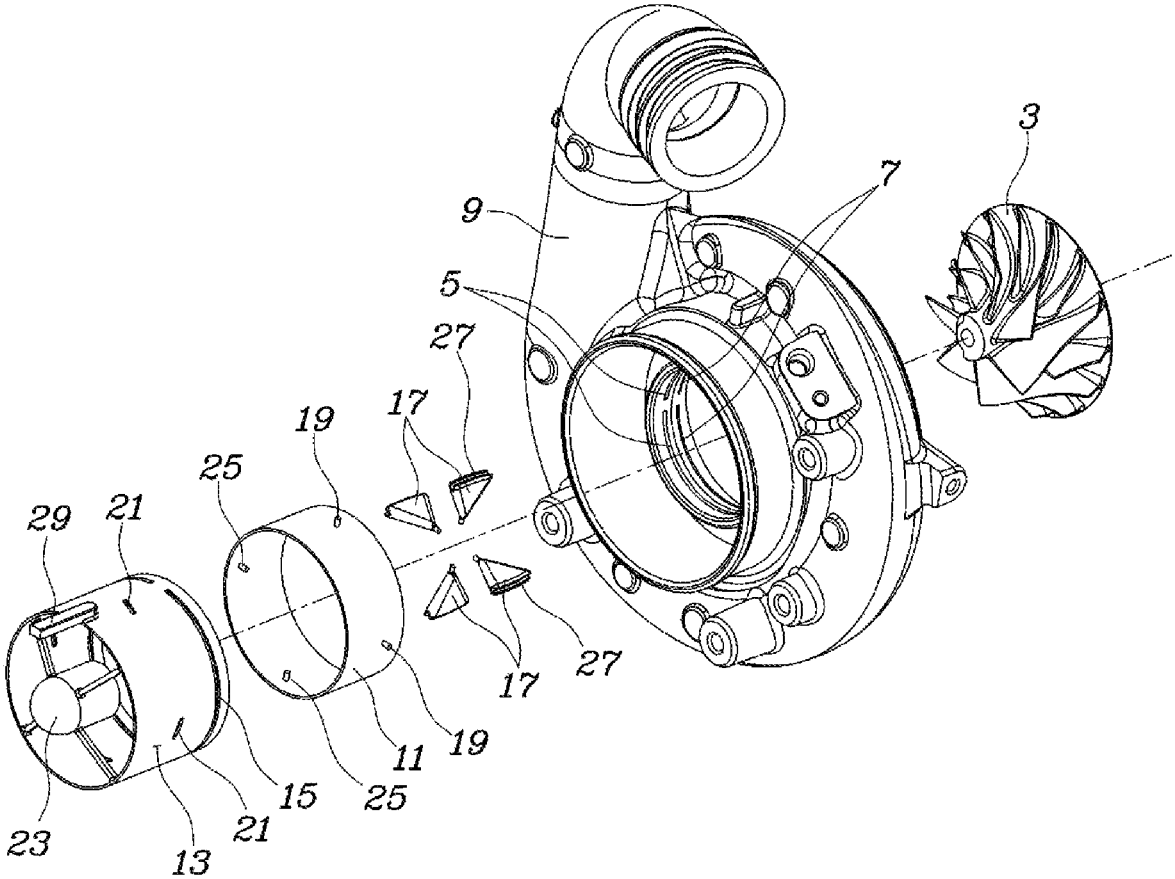
FIG. 2 is an exploded perspective view of FIG. 1.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIGS. 1 to 11, according to an exemplary embodiment of the present invention, a compressor 1 may include a compressor housing 9 configured to have a surge slit 5 and a choking slit 7 that are sequentially disposed along an axial direction of a compressor wheel 3; an internal sleeve 11 configured to be provided on the compressor housing 9 to guide a flow of gas introduced into the compressor wheel 3, form a concentric axis with the compressor wheel 3, and be rotatable on the concentric axis but unmovable along the axial direction; an external sleeve 13 configured to be provided on an external side of the internal sleeve 11 concentrically with the internal sleeve 11 and be linearly movable along the axial direction with respect to the compressor housing 9 but unrotatable; a rotation interlocking device configured to rotate the internal sleeve 11 depending on an axial linear movement of the external sleeve 13; a selection slit 15 configured to be provided on the external sleeve 13 to communicate with the surge slit 5 or communicate with the choking slit 7 depending on the axial linear movement of the external sleeve 13; and a plurality of vanes 17 configured to be provided on an internal side of the internal sleeve 11 to so that the vanes are rotated depending on the axial linear movement of the external sleeve 13 to adjust the flow of gas introduced into the compressor wheel 3.

That is, according to the exemplary embodiment of the present invention, a surge handling state in which the selection slit 15 communicates with the surge slit 5 by the axial linear movement of the external sleeve 13, and a choking handling state in which the selection slit 15 communicates with the choking slit 7 are formed so that it is possible to perform a function of suppressing surge in a situation where the surge occurs and a function of suppressing choking in a situation where the choking occurs, substantially increasing an effective operation area of the compressor.

Figure 3:
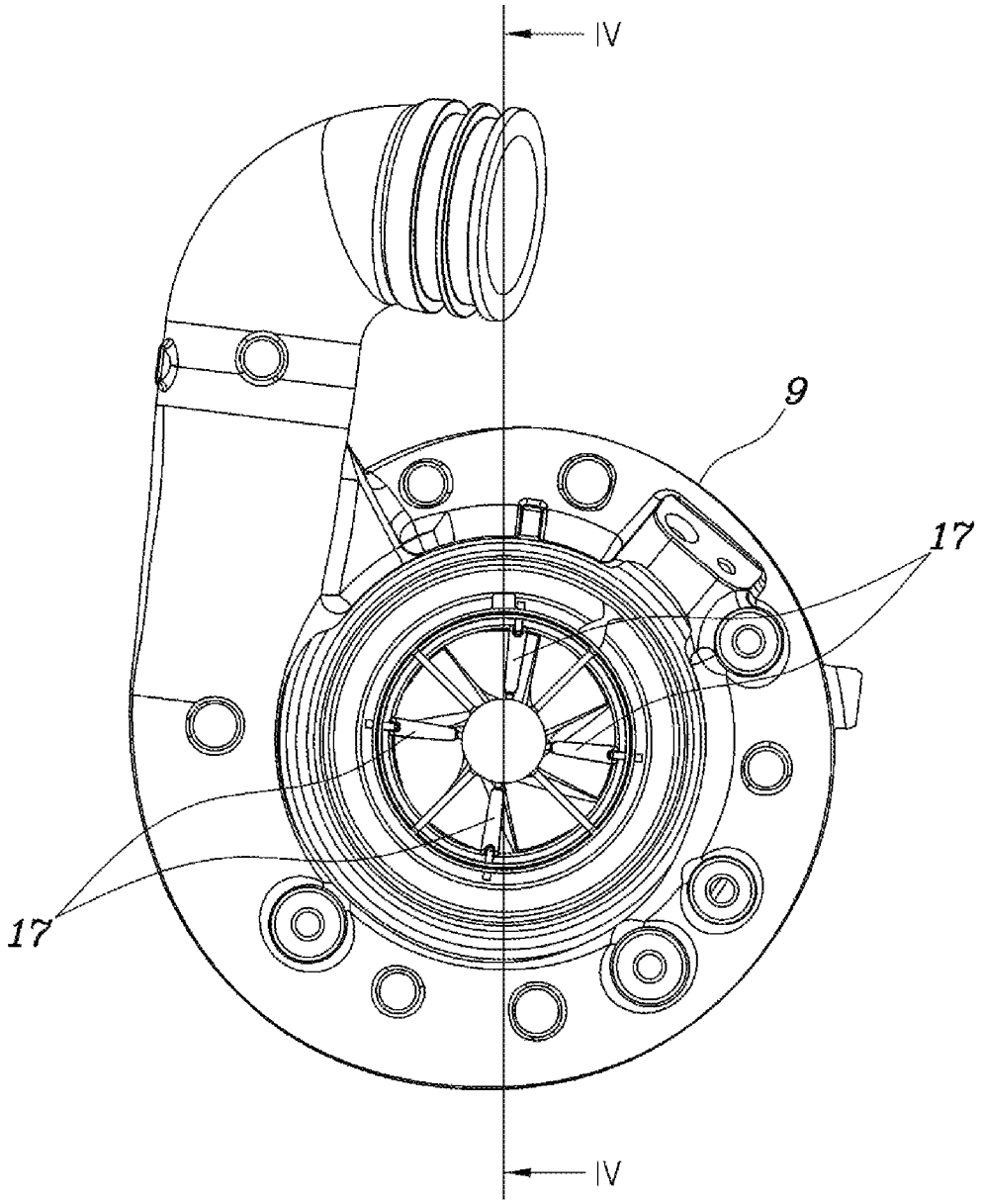
FIG. 3 is a front view of a neutral state of the compressor of FIG. 1.
Figure 4:
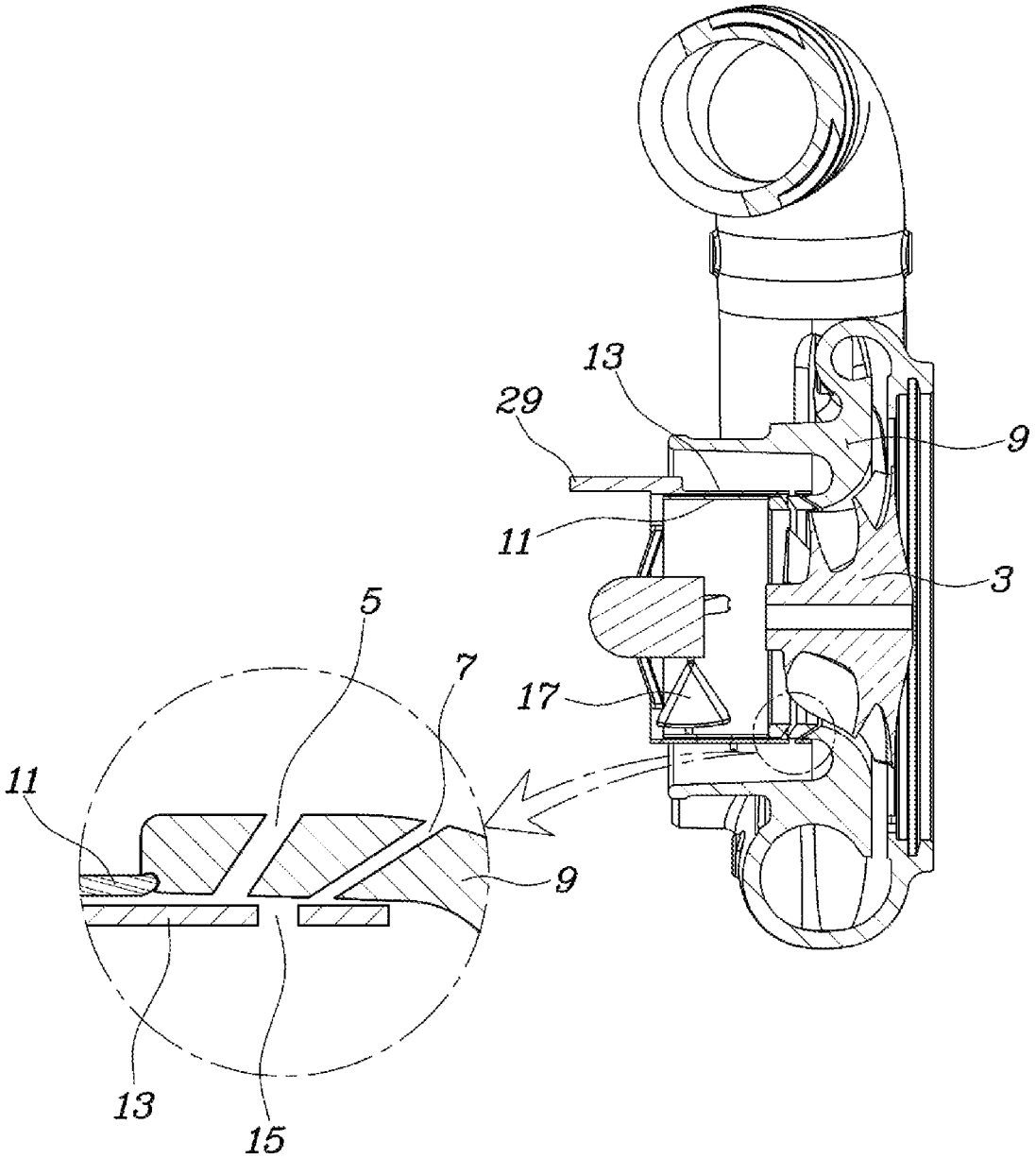
FIG. 4 is a cross-sectional view taken along line IV-IV of FIG. 3.
Figure 5:
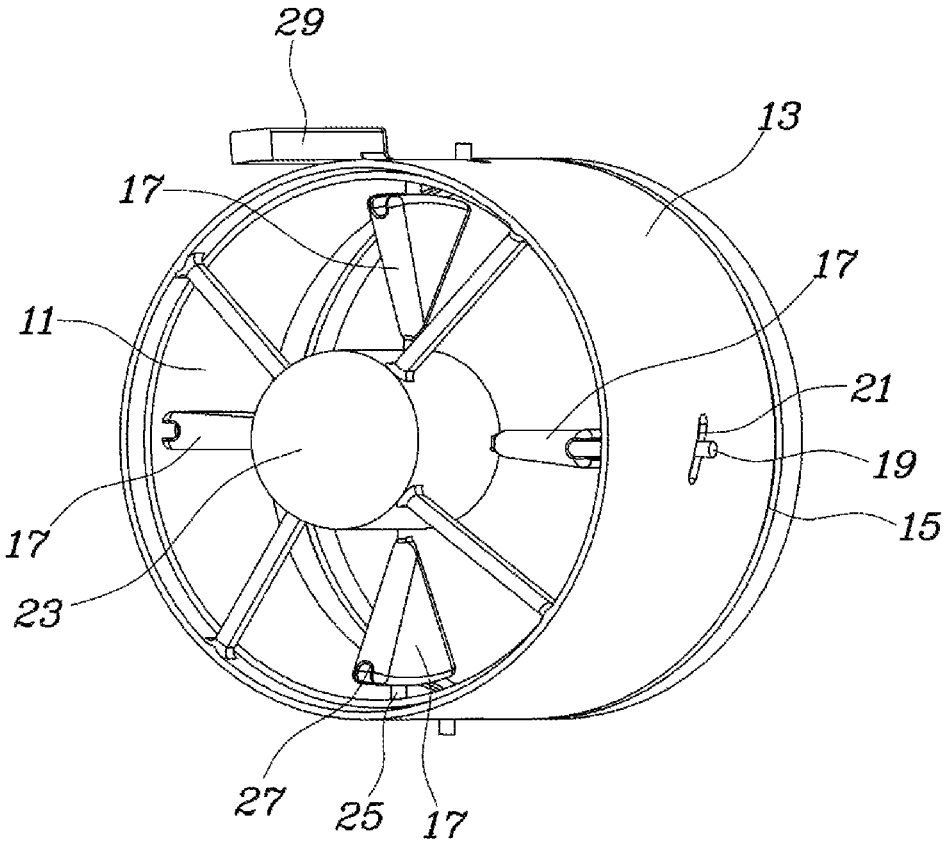
FIG. 5 is a perspective view illustrating an internal sleeve, an external sleeve, and a vane in the neutral state of FIG. 3.

For reference, states in FIGS. 3, 4 and 5 in which the selection slit 15 is positioned between the surge slit 5 and the choking slit 7 will be referred to as a neutral state.

Meanwhile, the compressor may form a turbocharger by connecting the compressor wheel 3 to a turbine rotating by engine exhaust gas, and may be configured to supply the gas compressed by the compressor wheel 3 and the compressor housing 9 to an intake side of the engine.

The surge slit 5 and the choking slit 7 are sequentially disposed at a portion surrounding a circumferential external side of the compressor wheel along the introduction direction of gas into the compressor wheel 3 such that some of the gas introduced into the compressor wheel 3 may be got out to an outside of the portion surrounding a circumferential external side of the compressor wheel 3.

The surge slit 5 and the choking slit 7 are each formed in a shape in which a plurality of arcs are disposed at intervals in parallel to a plane perpendicular to an axial direction of the compressor wheel 3 and the selection slit 15 of the external sleeve 13 is formed in an arc shape parallel to the plane perpendicular to the axial direction of the compressor wheel 3.

Therefore, when the external sleeve 13 enters the compressor wheel 3 from the neutral state, the selection slit 15 is in communication with the choking slit 7 and when the external sleeve 13 moves linearly away from the compressor wheel 3, the selection slit 15 is in communication with the surge slit 5.

According to the exemplary embodiment of the present invention, the rotation interlocking device is configured to include a plurality of external protrusions 19 protruding from the external circumferential surface of the internal sleeve 11; and inclined slits 21 formed on the external sleeve 13 to be inclined with respect to the axial direction so that the external protrusions 19 are inserted thereinto and guided.

That is, the external protrusion 19 of the internal sleeve 11 is rotated following the guide of the inclined slit 21 by the linear movement of the external sleeve 13, such that the internal sleeve 11 is rotated.

In addition to the above-mentioned exemplary embodiments, the rotation interlocking device may be implemented by forming a protruding portion facing the internal sleeve 11 on the internal side of the external sleeve 13 and forming an inclined groove on the internal sleeve 11 so that the protruding portion is inserted into the inclined groove.

An end portion of the internal sleeve 11 toward the compressor wheel 3 is inserted into the compressor housing 9 so that the internal sleeve 11 restrictively moves in the axial direction and is rotatable.

On the other hand, an inside center portion of the external sleeve 13 is provided with an ogive 23 for fixing a rotation shaft of the vane 17, an internal circumferential surface of the internal sleeve 11 is provided with a plurality of internal protrusions 25 protruding to rotate the vane 17, and the vane 17 is provided with protrusion guide grooves 27 having the internal protrusions 25 inserted thereinto to rotate the vane 17 depending on a displacement of the internal protrusion 25.

Therefore, when the axial linear movement of the external sleeve 13 occurs, the state in which the selection slit 15 is communicating with the surge slit 5 or the choking slit 7 is changed, and the vane 17 is rotated as the internal sleeve 11 is rotated and thus an angle of the vane 17 is changed.

The rotation shaft of the vane 17, the protrusion guide grooves 27, and the internal protrusions 25 of the internal sleeve 11 are formed such that the vane 17 is parallel to the axial direction of the compressor wheel 3 to allow the vane 17 to minimize a flow resistance of gas introduced into the compressor wheel 3 in the state where the selection slit 15 of the external sleeve 13 is positioned between the surge slit 5 and the choking slit 7 and the vanes 17 are rotated in inclined states in opposite directions to each other with respect to the axial direction at the states where the selection slit 15 communicates with the surge slit 5 or the choking slit 7, respectively.

Figure 6:
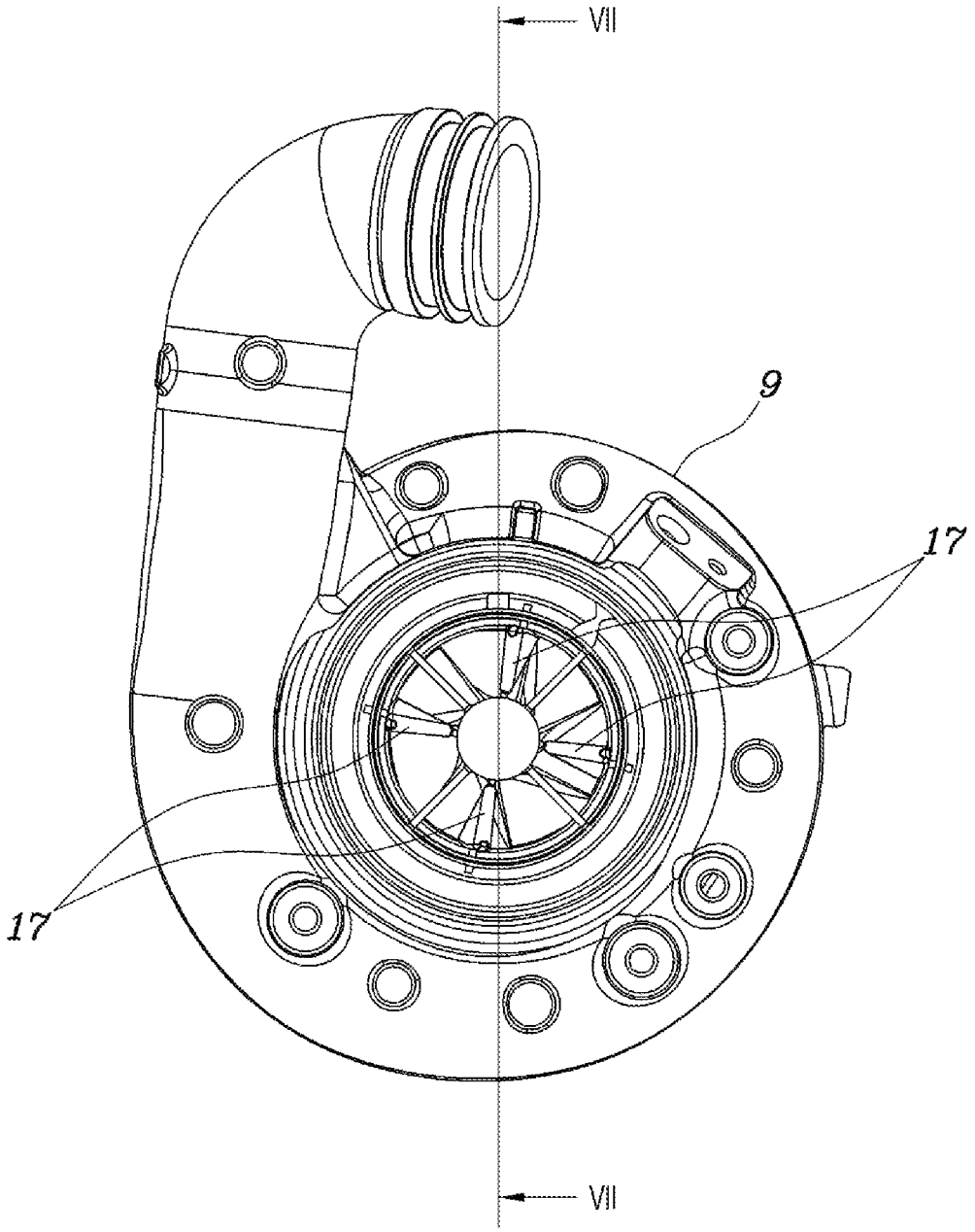
FIG. 6 is a front view of a choking handling state of the compressor of FIG. 1.
Figure 7:
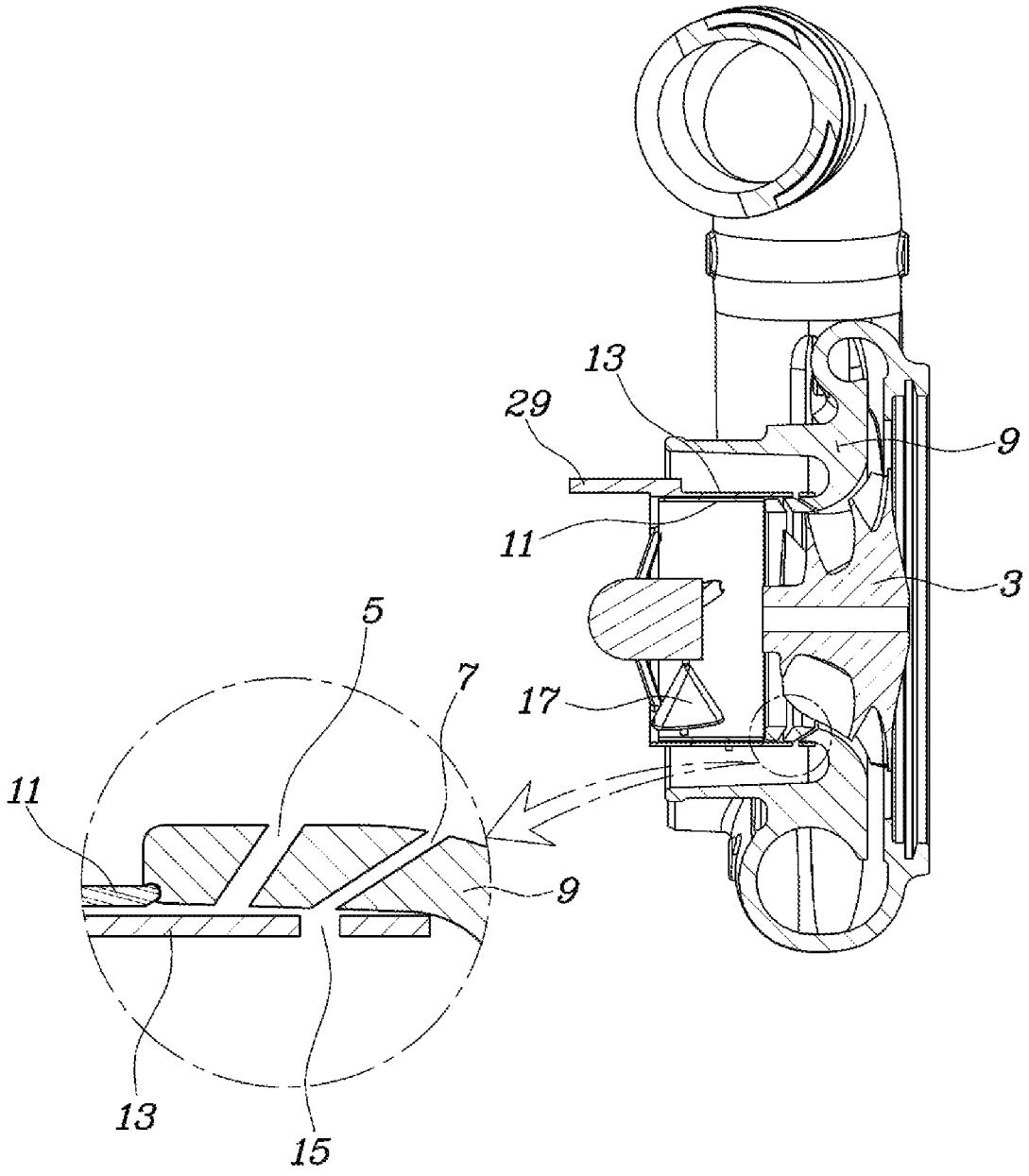
FIG. 7 is a cross-sectional view taken along line VII-VII of FIG. 6.
Figure 8:
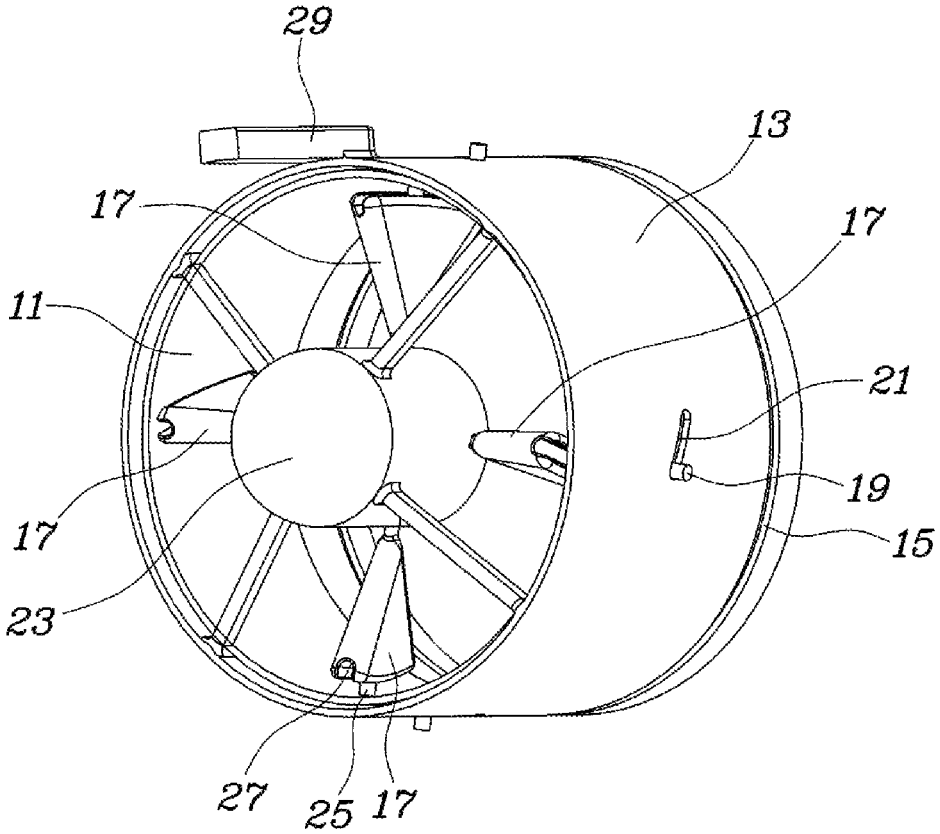
FIG. 8 is a perspective view illustrating the state of the internal sleeve, the external sleeve, and the vane in the choking handling state of FIG. 6.
Figure 9:
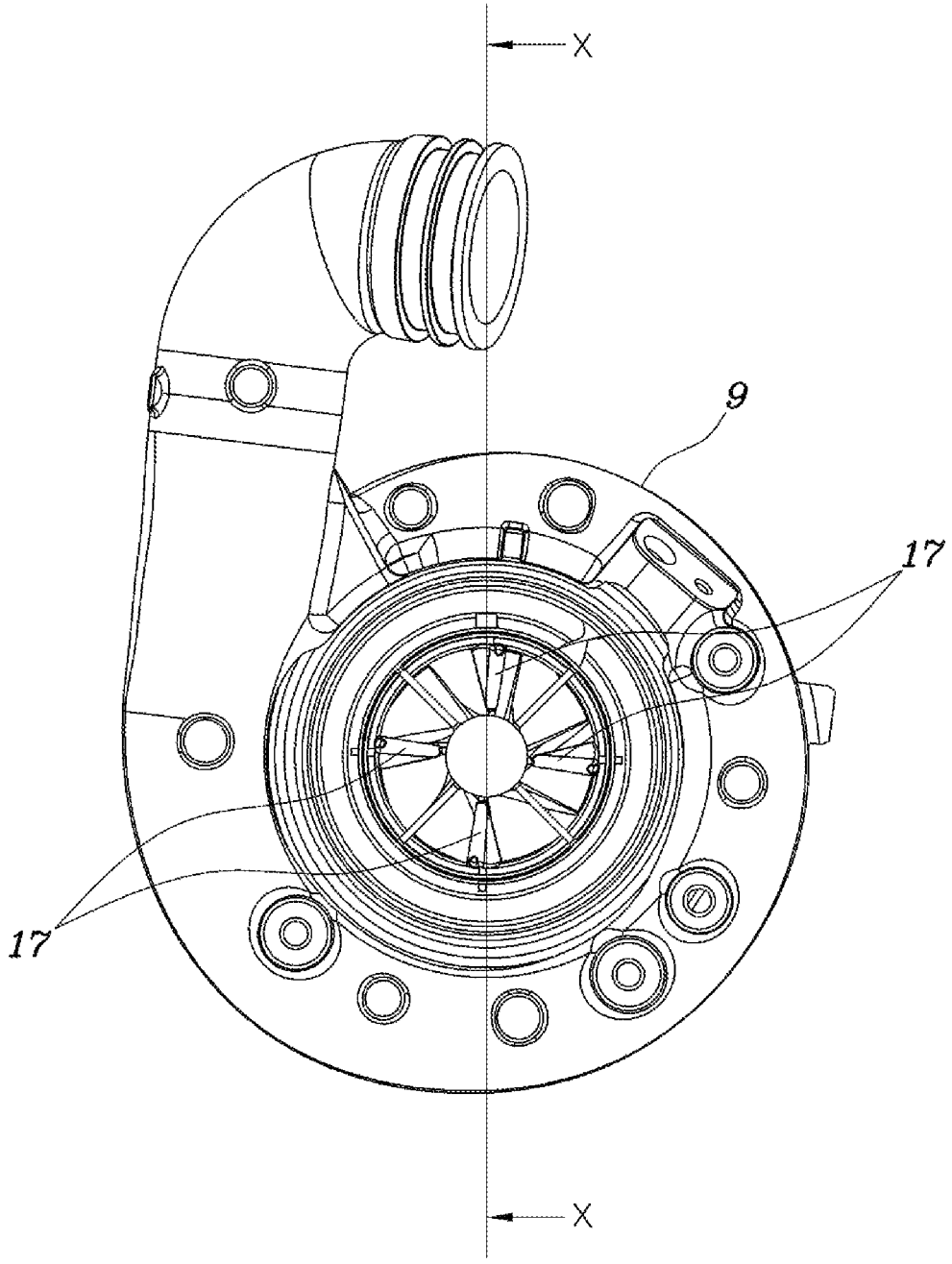
FIG. 9 is a front view of a surge handling state of the compressor of FIG. 1.
Figure 10:
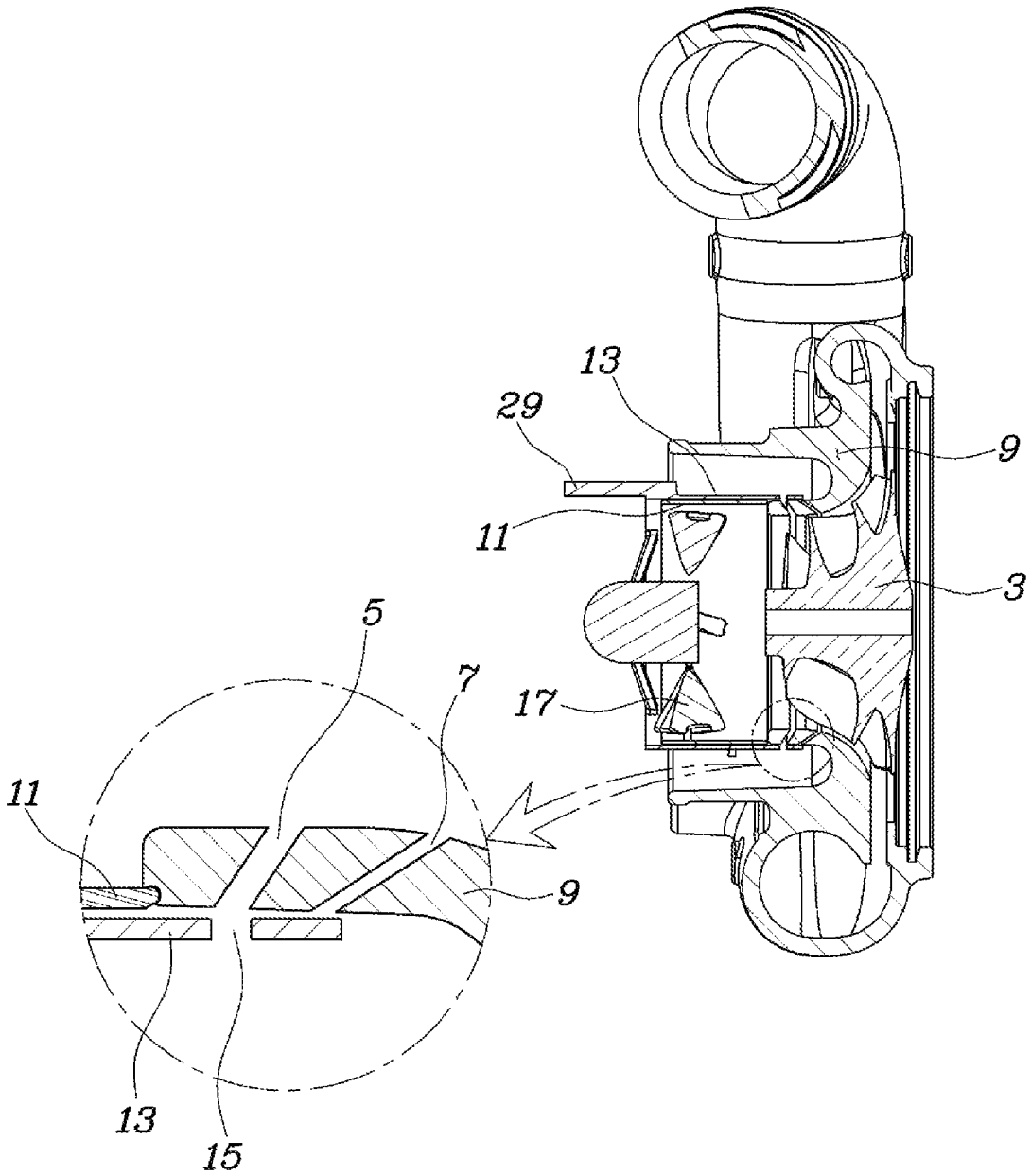
FIG. 10 is a cross-sectional view taken along line X-X of FIG. 9.
Figure 11:
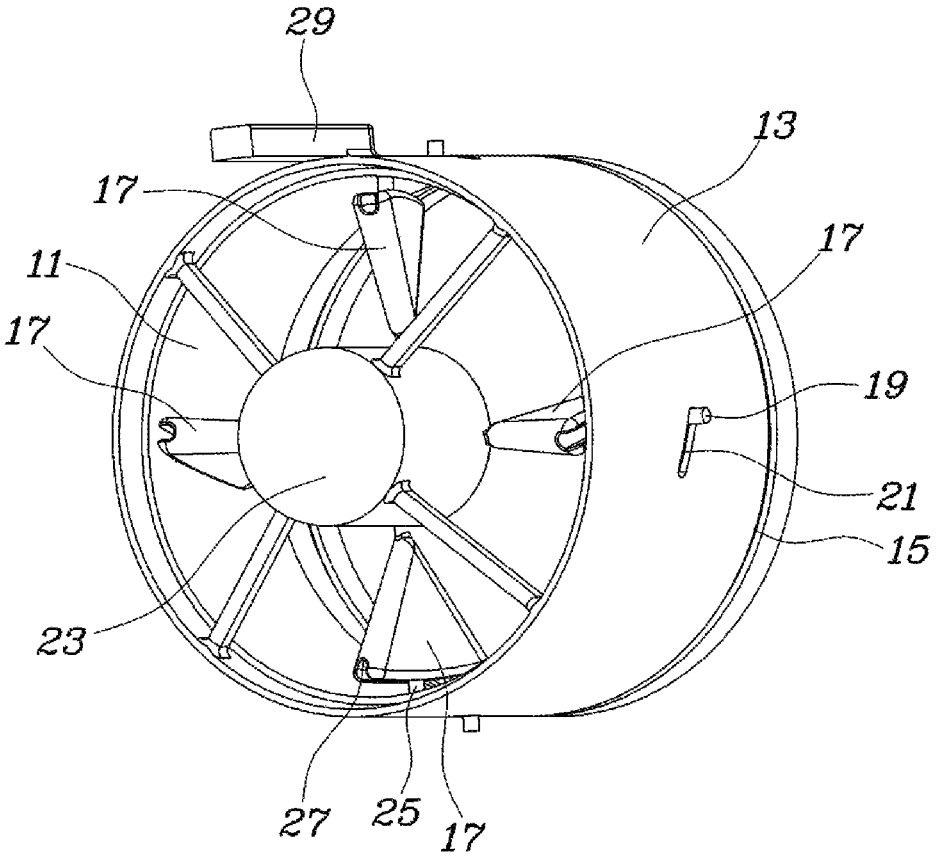
FIG. 11 is a perspective view illustrating the state of the internal sleeve, the external sleeve, and the vane in the surge handling state of FIG. 9.

That is, as illustrated in FIG. 3, FIG. 4, and FIG. 5, in the neutral state, the vane 17 is in parallel with the axial direction of the compressor wheel 3, as illustrated in FIGS. 6 to 8, in the choking handling state, the vane 17 is rotated in an inclined state with respect to the axial direction of the compressor wheel 3, and as illustrated in FIGS. 9 to 11, in the surge handling state, the vane 17 is rotated in an inclined state opposite to the inclined state of the choking handling state with respect to the axial direction of the compressor wheel 3.

On the other hand, the external sleeve 13 is integrally or monolithically provided with an operating rod 29 for receiving an operating force for linearly moving the external sleeve 13 along the axial direction thereof.

The operating rod 29 may be connected to various actuators including a motor and a hydraulic or pneumatic cylinder, configured for generating a linear displacement of the external sleeve 13. Further, the actuator may also be connected to the external sleeve itself without the operating rod.

According to an exemplary embodiment of the present invention configured as described above, the neutral state is formed in the normal operation state so that the state where the vanes 17 do not affect the flow of air introduced into the compressor wheel 3 as much as possible is maintained. Next, when the operation state of the compressor is changed and the compressor enters the operation area where the surge may occur, a separate controller configured for determining the situation drives the actuator to move the external sleeve 13 so that the selection slit 15 communicates with the surge slit 5, suppressing the occurrence of the surge. At the present point, the vanes 17 adjust the flowing direction of gas introduced into the compressor wheel 3 to help suppress the occurrence of the surge.

Further, when the operation state of the compressor changes and thus the compressor enters the operation area where the choking may occur, the controller moves the external sleeve 13 to allow the selection slit 15 to communicate with the choking slit 7, suppressing the occurrence of choking.

Further, the external sleeve 13 and the selection slit 15 of the present invention are configured to close both of the surge slit 5 and the choking slit 7 in the neutral state so that in the normal operating range of the compressor, the deterioration of the efficiency due to the gas bypassed through the surge slit 5 or the choking slit 7 can be prevented.

For reference, the fact that the surge is suppressed and the choking is suppressed by the communication of the surge slit 5 with the selection slit 15 or the communication of the choking slit 7 with the selection slit 15 is based on the already known principle and thus the detailed description thereof will be omitted.

According to the exemplary embodiment of the present invention, the compressor can prevent the surge or choking from occurring as much as possible even under the conditions that the operation area of the compressor enters the surge area or the choking area to substantially reduce the surge area or the choking area and increase the effective operation area of the compressor, improving the operation stability of the compressor to contribute to the improvement in the output performance of the vehicle.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A compressor, comprising:

a compressor housing having a surge slit and a choking slit that are sequentially disposed along an axial direction of a compressor wheel;

an internal sleeve configured to be provided on the compressor housing to guide a flow of gas introduced into the compressor wheel, form a concentric axis with the compressor wheel, and be rotatable on the concentric axis but unmovable along the axial direction;

an external sleeve configured to be provided on an external side of the internal sleeve concentrically with the internal sleeve and be linearly movable along the axial direction with respect to the compressor housing but unrotatable;

a rotation interlocking device rotating the internal sleeve depending on an axial linear movement of the external sleeve;

a selection slit provided on the external sleeve to communicate with the surge slit or communicate with the choking slit depending on the axial linear movement of the external sleeve; and a plurality of vanes provided on an internal side of the internal sleeve wherein the vanes are rotated depending on the axial linear movement of the external sleeve to adjust the flow of the gas introduced into the compressor wheel, wherein the plurality of vanes are provided at a front of the compressor wheel to surround a circumferential internal side of the compressor wheel.

2. The compressor of claim 1, wherein the surge slit and the choking slit are sequentially disposed at a portion surrounding a circumferential external side of the compressor wheel along an introduction direction of the gas into the compressor wheel, such that a portion of the gas introduced into the compressor wheel is got out.

3. The compressor of claim 2, wherein the surge slit and the choking slit are each formed in a shape in which a plurality of arcs are disposed at intervals in parallel to a plane perpendicular to the axial direction of the compressor wheel.

4. The compressor of claim 3, wherein the selection slit of the external sleeve is formed in an arc shape parallel to the plane perpendicular to the axial direction of the compressor wheel.

5. The compressor of claim 2, wherein the rotation interlocking device includes:

a plurality of external protrusions configured to protrude from an external circumferential surface of the internal sleeve; and inclined slits formed on the external sleeve to be inclined with respect to the axial direction so that the external protrusion is inserted thereinto and guided.

6. The compressor of claim 2, wherein an inside center portion of the external sleeve is provided with an ogive for fixing a rotation shaft of the vanes, an internal circumferential surface of the internal sleeve is provided with a plurality of internal protrusions protruding to rotate the vanes, and the vane is provided with protrusion guide grooves having the internal protrusions inserted thereinto to rotate the vanes depending on a displacement of the internal protrusions.

7. The compressor of claim 6, wherein the rotation shaft of the vane, the protrusion guide grooves, and the internal protrusions of the internal sleeve are formed such that the vanes are in parallel to the axial direction of the compressor wheel to allow the vanes to minimize a flow resistance of gas introduced into the compressor wheel in a state where the selection slit of the external sleeve is disposed between the surge slit and the choking slit, and the vanes are rotated in inclined states in opposite directions to each other with respect to the axial direction in the states where the selection slit communicates with the surge slit or the choking slit, respectively.

8. The compressor of claim 1, wherein the external sleeve is integrally provided with an operating rod for receiving an actuating force for linearly moving the external sleeve along the axial direction thereof.

* * * * *